United States Patent [19]

Mar

[11] Patent Number: 4,830,345

[45] Date of Patent: May 16, 1989

[54] SPRING-LOADED SEAT ASSEMBLY

[75] Inventor: Shih L. Mar, 3 fl., No. 10, Lane 134, Tzu Li St., Hsin Tien City, Taipei Hsien, Taiwan

[73] Assignees: Wen Lin Chen, Teipei and Shih Lin Mar, Taipei Hsien, both at Taiwan

[21] Appl. No.: 122,441

[22] Filed: Nov. 19, 1987

[51] Int. Cl.[4] ..... F16F 3/04; A47C 7/14

[52] U.S. Cl. ..... 267/133; 248/624; 267/169; 267/178; 272/136; 297/314

[58] Field of Search ..... 267/131, 133, 142, 166, 267/169, 178, 91, 101; 297/312, 313, 314; 248/624, 619; 272/67, 85, 93, 135, 136.

[56] References Cited

U.S. PATENT DOCUMENTS

| | | | |
|---|---|---|---|
| 1,303,962 | 5/1919 | Reed | 248/624 |
| 1,696,797 | 12/1928 | Fornaca | 267/169 X |
| 2,132,291 | 10/1938 | Fitas | 297/314 X |
| 2,494,094 | 1/1950 | Horstman | 272/136 |
| 2,615,495 | 10/1952 | Hilliker | 297/313 X |
| 2,690,845 | 10/1954 | Macomber | 267/178 X |
| 2,781,083 | 2/1957 | Agrillo | 267/142 X |
| 3,260,522 | 7/1966 | White et al. | 272/85 |
| 3,497,216 | 2/1970 | Feather | 272/141 X |

FOREIGN PATENT DOCUMENTS

| | | | |
|---|---|---|---|
| 540714 | 1/1932 | Fed. Rep. of Germany | 248/624 |
| 1373584 | 11/1974 | United Kingdom | 297/313 |

*Primary Examiner*—George E. A. Halvosa
*Attorney, Agent, or Firm*—Staas & Halsey

[57] ABSTRACT

A cushion comprising two seat pieces combined with inside faces facing towards each other, and a plurality of coil spring members which connect the two seat pieces. Each of the seat pieces is a shallow circular plate having a smooth central concavity and includes internally a series of concentrically extending walls, a series of radially extending walls, and a plurality of appropriately spaced tubular walls with an upstanding cylinder formed inside. Each of the coil spring members is closely coiled at its two terminals and encompasses corresponding cylinders of the two seat pieces.

1 Claim, 4 Drawing Sheets

SPRING-LOADED SEAT ASSEMBLY

BACKGROUND OF THE INVENTION

The present invention relates to a seat assembly, and more particularly, to a spring-loaded seat assembly capable of vibration or undulation when subject to pressure due to a user sitting thereon.

It is observed that when a person sits on the seat assembly of this invention, such an action, besides resulting in working of the muscles of the lower trunk, also results in a beneficial stimulation of the lower trunk. The person using the apparatus is able to exercise his lower limbs in a wide range of circumference.

SUMMARY OF THE INVENTION

It is a primary object of the present invention to provide a seat assembly with two circular seat pieces, which are combined by using a plurality of coil spring members, for the purpose of vibrating or undulating the upper circular seat piece substantially up and down and/or three dimensionally so as to exercise the user's body when the cushion is being used.

Another object of the present invention is to provide a seat assembly, either side of which can be sat on.

Further objects and advantages of the present invention, which would be apparent after a careful reading of the detailed description provided hereinafter, are accomplished by having a spring-loaded seat assembly comprising two seat pieces assembled with inside faces facing towards each other, and a plurality of coil spring members which connect the two seat pieces. Each of the seat pieces is a shallow circular plate having a smooth central concavity and includes internally a series of concentrically extending walls, a series of radially extending walls, and a plurality of appropriately spaced tubular walls with an upstanding cylinder formed inside. Each of the coil spring members is closely coiled at its two terminals and encompasses corresponding cylinders of the two seat pieces.

DETAILED DESCRIPTION OF THE PREFERRED EMBODIMENT

Figure 1:
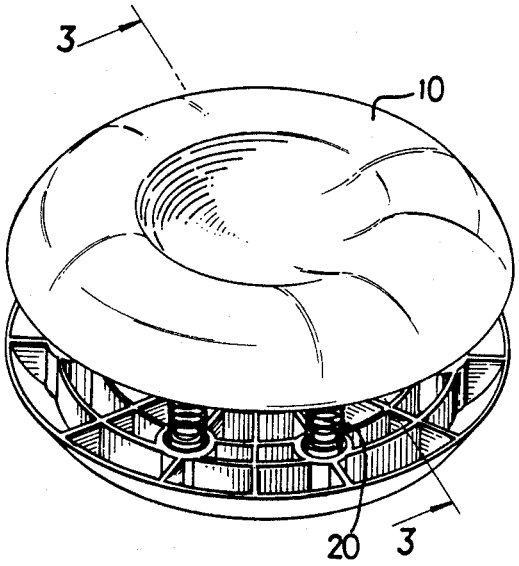
FIG. 1 is a perspective view of a spring-loaded seat assembly in accordance with the present invention.

Referring to the drawings and initially to FIG. 1, it can be seen that a spring-loaded seat assembly in accordance with the present invention comprises two identical circular seat pieces 10 which are assembled in an inside face to inside face manner, and a plurality of coil spring members 20 which connect the two circular seat pieces 10.

Figure 2:
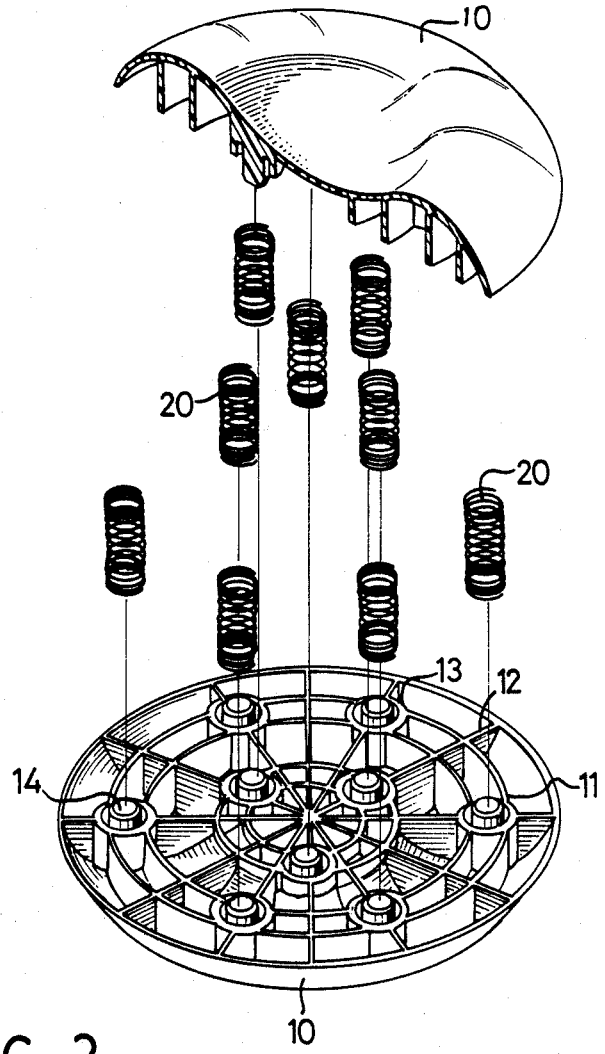
FIG. 2 is an exploded view of the spring-loaded seat assembly shown in FIG. 1, with a portion thereof being cut away for clarity.
Figure 3:
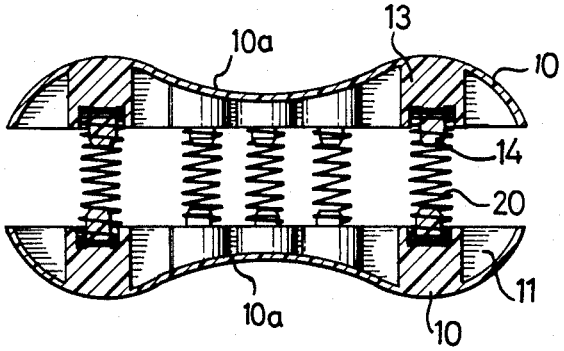
FIG. 3 is a sectional view taken along line 3—3 of FIG. 1.

Referring to FIGS. 2 and 3, each circular seat piece 10 is a shallow circular plate having a smooth central concavity, and includes a series of concentrically extending walls 11, a series of radially extending walls 12, and a plurality of tubular walls 13 with respective upstanding cylinder 14 formed therein. The tubular walls 13 are evenly spaced on the concentrically extending walls 11.

The concentrically and radially extending walls 11 and 12 stand to be a reinforcement for the structure of the circular seat piece 10.

Referring again to FIGS. 2 and 3, it can be seen that a plurality of coil spring members 20, each of which is closely coiled at the two opposite ends thereof, encompass corresponding cylinders 14 of the two seat pieces 10. Thus, the two seat pieces 10 are combined to form a spring-loaded seat assembly.

When a person sits on the seat assembly, the upper of the two seat pieces 10 undulates and is thus inherently unstable since it is virtually impossible to evenly apply force to the contour of the upper seat piece 10. As shown in FIG. 3, each seat piece 10 has a curved outer surface 10*a* which preferably forms an undulating contour. Therefore, the force exerted on each of the coil spring members 20 is unevenly distributed.

Figure 4:
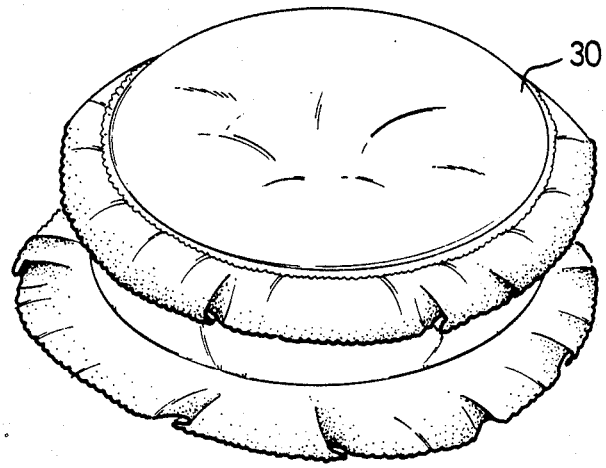
FIG. 4 is a perspective view of the spring-loaded seat assembly after being upholstered.

The spring-loaded cushion can also be embodied after being upholstered with soft mat 30, as depicted in FIG. 4. The user can sit on either face of the seat assembly and can use the seat assembly alone or in combination with a bed or a chair.

While the invention has been explained in relation to its preferred embodiment, it is to be understood that various modifications and alterations thereof will become apparent to those skilled in the art upon reading this specification. Therefore, it is to be understood that the invention disclosed herein is intended to cover all such modifications or alterations as fall within the scope of the appended claim.

I claim:

1. A spring-loaded seat assembly for sitting thereupon, comprising:

two spaced apart seat pieces assembled in an inside face to inside face manner, each of said seat pieces having oppositely facing sitting surfaces, and each being a shallow circular plate with a smooth central concavity having internally a series of concentrically extending walls, a series of radially extending walls, and a plurality of tubular walls with respective upstanding cylinders formed therein, said tubular walls being evenly spaced on the concentrically extending walls; and a plurality of coil spring members elastically interconnecting the two seat pieces, each of said coil spring members being closely coiled at both opposite ends thereof for attachment to corresponding cylinders of said two seat pieces.

* * * * *